US011202466B2

(12) United States Patent
Prestia et al.

(10) Patent No.: US 11,202,466 B2
(45) Date of Patent: Dec. 21, 2021

(54) METHOD FOR MANUFACTURING INDUCTIVELY HEATABLE TOBACCO RODS

(71) Applicant: PHILIP MORRIS PRODUCTS S.A., Neuchatel (CH)

(72) Inventors: Ivan Prestia, Longara di Calderara di Reno (IT); Daniele Sanna, Marin-Epagnier (CH); Christian Agostini, Bologna (IT); Alessandro Balboni, Comacchio (IT)

(73) Assignee: Philip Morris Products S.A., Neuchatel (CH)

( * ) Notice: Subject to any disclaimer, the term of this patent is extended or adjusted under 35 U.S.C. 154(b) by 16 days.

(21) Appl. No.: 16/793,438

(22) Filed: Feb. 18, 2020

(65) Prior Publication Data

US 2020/0214335 A1 Jul. 9, 2020

Related U.S. Application Data

(62) Division of application No. 15/569,227, filed as application No. PCT/EP2016/061169 on May 19, 2016, now Pat. No. 10,588,337.

(30) Foreign Application Priority Data

May 21, 2015 (EP) ..... 15168554

(51) Int. Cl.
*A24B 3/14* (2006.01)
*A24C 5/01* (2020.01)
(Continued)

(52) U.S. Cl.
CPC ..... *A24C 5/01* (2020.01); *A24B 3/14* (2013.01); *A24D 1/20* (2020.01); *A24F 40/20* (2020.01); *A24F 40/465* (2020.01)

(58) Field of Classification Search
CPC ..... A24D 1/20; A24D 1/22; A24F 40/465
See application file for complete search history.

(56) References Cited

U.S. PATENT DOCUMENTS 5,099,861 A * 3/1992 Clearman ..... A24D 1/22 131/194
5,613,505 A 3/1997 Campbell
(Continued)

FOREIGN PATENT DOCUMENTS

WO WO 97/27411 10/1995
WO WO 2012/164009 12/2012
(Continued)

OTHER PUBLICATIONS

PCT/EP2016/061169 International Search Report and Written Opinion dated Aug. 11, 2016 (9 pages).

*Primary Examiner* — Eric Yaary
(74) *Attorney, Agent, or Firm* — Mueting Raasch Group

(57) ABSTRACT

The method for manufacturing inductively heatable tobacco rods comprises the steps of providing a continuous profile of a susceptor, guiding an aerosol-forming tobacco substrate along a tobacco substrate converging device, positioning the continuous profile of susceptor in the aerosol-forming tobacco substrate and converging the aerosol-forming tobacco substrate to a final rod shape. Therein, the step of positioning the continuous profile of susceptor in the aerosol-forming tobacco substrate is performed before performing the step of converging the aerosol-forming tobacco substrate to its final rod shape.

16 Claims, 3 Drawing Sheets

(51) Int. Cl.

| | |
|---|---|
| ***A24D 1/20*** | (2020.01) |
| *A24F 40/20* | (2020.01) |
| *A24F 40/465* | (2020.01) |

(56) References Cited

U.S. PATENT DOCUMENTS

| | | | | |
|---|---|---|---|---|
| 2014/0166032 | A1 | 6/2014 | Gindrat | |
| 2015/0272219 | A1 | 10/2015 | Hatrick | |
| 2016/0021934 | A1* | 1/2016 | Cadieux ..... | A61M 15/06 131/328 |

FOREIGN PATENT DOCUMENTS

| | | |
|---|---|---|
| WO | WO 2013/178768 | 12/2013 |
| WO | WO 2014/048745 | 4/2014 |

* cited by examiner

METHOD FOR MANUFACTURING INDUCTIVELY HEATABLE TOBACCO RODS

This application is a divisional application of U.S. application Ser. No. 15/569,227, filed Oct. 25, 2017 and which is a U.S. National Stage Application of International Application No. PCT/EP2016/061169, filed May 19, 2016, which was published in English on Nov. 24, 2016, as International Publication No. WO 2016/184928 A1. International Application No. PCT/EP2016/061169 claims priority to European Application No. 15168554.2 filed May 21, 2015.

The present invention relates to a method for manufacturing inductively heatable tobacco rods for use in inductive heating devices.

From the prior art aerosol-delivery systems are known, which comprise an aerosol-forming substrate and an inductive heating device. The inductive heating device comprises an induction source which produces an alternating electromagnetic field which induces heat generating eddy currents and hysteresis losses in a susceptor. The susceptor is in thermal proximity of the aerosol-forming substrate, for example a tobacco substrate. The heated susceptor in turn heats the aerosol-forming substrate which comprises a material which is capable of releasing volatile compounds that can form an aerosol.

It would be desirable to have an efficient method for manufacturing inductively heatable aerosol-forming tobacco rods suitable for use in inductive heating devices.

According to an aspect of the present invention, there is provided a method for manufacturing inductively heatable tobacco rods. The method comprises the steps of providing a continuous profile of a susceptor, guiding an aerosol-forming tobacco substrate along a tobacco substrate converging device and positioning the continuous profile of susceptor in the aerosol-forming tobacco substrate. A further step of the method comprises converging the aerosol-forming tobacco substrate to a final rod shape, wherein the step of positioning the continuous profile of susceptor in the aerosol-forming tobacco substrate is performed before performing the step of converging the aerosol-forming tobacco substrate to its final rod shape.

The provision of two types of continuous material brought together in a continuous process for the manufacture of an inductively heatable tobacco rod is a very efficient manner for mass production of inductively heatable tobacco segments. In addition, the manufacture of tobacco rods provides flexibility in the dimensioning of the tobacco segments or of inductively heatable tobacco plugs, respectively, as the final tobacco segments are typically named. Variations, for example but not limited to: susceptor profile form, type of susceptor, location of susceptor in the tobacco substrate, type of tobacco substrate or length and lateral dimension of tobacco rod, are achievable. Preferably, such variations may be achieved without or with only limited adaption of the manufacturing process of conventional tobacco rods, that is, tobacco rods used for the manufacture of tobacco plugs for heating devices comprising conventional resistance heating elements such as for example heating blades.

The continuous profile of susceptor is positioned in the tobacco substrate, while the tobacco substrate has been partially converged but has not yet achieved the final rod shape. The partially converged tobacco substrate may be a loose arrangement of gathered tobacco substrate, basically of any form or shape, or may already have a rod shape, however with a lower density (or larger diameter) than in the final rod shape. By positioning the susceptor in the partially converged tobacco substrate, the introduction of the susceptor profile in the tobacco substrate is facilitated. In addition, due to the already (partially) converged tobacco material, the final position of the susceptor in the tobacco rod is already well defined.

As used herein, the term 'susceptor' refers to a material that is capable to convert electromagnetic energy into heat. When located in an alternating electromagnetic field, eddy currents are induced and hysteresis losses occur in the susceptor causing heating of the susceptor. As the susceptor is located in thermal contact or close thermal proximity with the aerosol-forming tobacco substrate, the aerosol-forming tobacco substrate is heated by the susceptor such that an aerosol is formed. Preferably, the susceptor is arranged in direct physical contact with the aerosol-forming tobacco substrate, for example within the aerosol-forming tobacco substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor may be a multi-material susceptor and may comprise a first susceptor material and a second susceptor material. The first susceptor material is disposed in intimate physical contact with the second susceptor material. The second susceptor material preferably has a Curie temperature that is lower than 500° C. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate and the temperature control of the heating may be separated. The first susceptor material is preferably a magnetic material having a Curie temperature that is above 500° C. It is desirable from the point of view of heating efficiency that the Curie temperature of the first susceptor material is above any maximum temperature that the susceptor should be capable of being heated to. The second Curie temperature may preferably be selected to be lower than 400° C., preferably lower than 380° C., or lower than 360° C. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-forming substrate. The second Curie temperature may, for example, be within the range of 200° C. to 400° C., or between 250° C. and 360° C. The second Curie temperature of the second susceptor material may, for example, be selected such that, upon being heated by a susceptor that is at a temperature equal to the second Curie temperature, an overall average temperature of the aerosol-forming substrate does not exceed 240° C.

Preferably, the continuous profile of susceptor is a filament, rod, sheet or band. If the susceptor profile is of constant cross-section, for example a circular cross-section, it has a preferable width or diameter of between about 1 millimeter and about 5 millimeter. If the susceptor profile has the form of a sheet or band, the sheet or band preferably has a rectangular shape having a width preferably between about 2 millimeter and about 8 millimeter, more preferably, between about 3 millimeter and about 5 millimeter, for example 4 millimeter and a thickness preferably between about 0.03 millimeter and about 0.15 millimeter, more preferably between about 0.05 millimeter and about 0.09 millimeter, for example 0.07 millimeter.

Preferably, the aerosol-forming tobacco substrate contains volatile tobacco flavour compounds, which are released from the tobacco substrate upon heating. The aerosol-forming tobacco substrate may comprise or consist of blended tobacco cut filler or may comprise homogenised tobacco material. Homogenised tobacco material may be formed by agglomerating particulate tobacco. The aerosol-forming substrate may additionally comprise a non-tobacco-containing material, for example homogenised plant-based material other than tobacco.

Preferably, the aerosol-forming tobacco substrate is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

Tobacco particles may be of the form of a tobacco dust having particles in the order of 30 micrometers to 250 micrometers, preferably in the order of 30 micrometers to 80 micrometers or 100 micrometers to 250 micrometers, depending on the desired sheet thickness and casting gap, where the casting gap typically defines the thickness of the sheet.

Fiber particles may include tobacco stem materials, stalks or other tobacco plant material, and other cellulose-based fibers such as wood fibers having a low lignin content. Fiber particles may be selected based on the desire to produce a sufficient tensile strength for the cast leaf versus a low inclusion rate, for example, an inclusion rate between approximately 2 percent to 15 percent. Alternatively, fibers, such as vegetable fibers, may be used either with the above fiber particles or in the alternative, including hemp and bamboo.

Aerosol formers included in the slurry forming the cast leaf or used in other aerosol-forming tobacco substrates may be chosen based on one or more characteristics. Functionally, the aerosol former provides a mechanism that allows it to be volatilized and convey nicotine or flavouring or both in an aerosol when heated above the specific volatilization temperature of the aerosol former. Different aerosol formers typically vaporize at different temperatures. The aerosol-former may be any suitable known compound or mixture of compounds that, in use, facilitates formation of a dense and stable aerosol and that is substantially resistant to thermal degradation at the operating temperature of an inductive heating device the inductively heatable tobacco substrate shall be used with. An aerosol former may be chosen based on its ability, for example, to remain stable at or around room temperature but able to volatize at a higher temperature, for example, between 40 degree Celsius and 450 degree Celsius.

The aerosol former may also have humectant type properties that help maintain a desirable level of moisture in an aerosol-forming substrate when the substrate is composed of a tobacco-based product, particularly including tobacco particles. In particular, some aerosol formers are hygroscopic material that functions as a humectant, that is, a material that helps keep a tobacco substrate containing the humectant moist.

One or more aerosol former may be combined to take advantage of one or more properties of the combined aerosol formers. For example, triacetin may be combined with glycerin and water to take advantage of the triacetin's ability to convey active components and the humectant properties of the glycerin.

Aerosol formers may be selected from the polyols, glycol ethers, polyol ester, esters, and fatty acids and may comprise one or more of the following compounds: glycerin, erythritol, 1,3-butylene glycol, tetraethylene glycol, triethylene glycol, triethyl citrate, propylene carbonate, ethyl laurate, triacetin, meso-Erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

The aerosol-forming tobacco substrate may comprise other additives and ingredients, such as flavourants. The aerosol-forming tobacco substrate preferably comprises nicotine and at least one aerosol-former. The susceptor being in thermal proximity of or in thermal or physical contact with the aerosol-forming tobacco substrate allows for a more efficient heating and thus, higher operating temperatures may be reached. The higher operating temperature enables glycerin to be used as an aerosol-former which provides an improved aerosol as compared to the aerosol-formers used in the known systems.

A crimped tobacco sheet, for example a cast leaf, may have a thickness in a range of between about 0.5 millimeter and about 2 millimeter, preferably between about 0.8 millimeter and about 1.5 millimeter, for example 1 millimeter. Deviations in thickness of up to about 30 percent may occur due to manufacturing tolerances.

Preferably, the inductively heatable tobacco rod has a circular or oval cross-section. However, the tobacco rod may also have the cross-section of a rectangle or of a polygon.

According to an aspect of the method according to the invention, the method further comprises the step of inserting the continuous profile of susceptor from below into the tobacco substrate.

Insertion and corresponding supply of the continuous profile of susceptor from below a transport line allows for a space-saving set-up of a manufacturing line. Preferably, tobacco substrate crimping, folding and gathering devices are arranged at and along a transport line, while supply, transport and guiding elements for the susceptor may be arranged below the transport line. Preferably, at the latest at an insertion position of a susceptor into a tobacco substrate, susceptor and tobacco substrate are guided in parallel and along the transport line.

Preferably, the continuous profile of susceptor is positioned in a central portion of the tobacco substrate. This may be favorable in view of heat distribution in the tobacco substrate, for example for a homogeneous or symmetric heat distribution in the tobacco rod. Heat generated in the central portion may dissipate in radial direction and heat-up tobacco substrate around an entire circumference of the susceptor.

Preferably, a central portion of the tobacco substrate is a region of the tobacco rod encompassing a central axis of the tobacco rod. The susceptor is arranged substantially longitudinally within the tobacco rod. This means that the length dimension of the susceptor is arranged to be approximately parallel to a longitudinal direction of the tobacco rod, for example within plus or minus 10 degrees of parallel to the longitudinal direction of the tobacco rod. Preferably, the susceptor may be positioned in a radially central position within the tobacco rod, and extends along the longitudinal axis of the tobacco rod.

According to another aspect of the method according to the invention, the method further comprises the step of providing the tobacco substrate with a longitudinally running folding structure. The step of positioning the continuous profile of susceptor in the tobacco substrate then comprises arranging the continuous profile of susceptor material parallel to and in between the longitudinally running folding structure of the tobacco substrate. This may facilitate the insertion and positioning of the susceptor in the tobacco material.

The tobacco substrate may be provided with a folding structure to facilitate the folding of the substrate to its final rod shape. Such a folding structure may support a regular folding and thus the manufacture of tobacco plugs with reproducible specifications. The continuous profile of susceptor may now be arranged in between folds, preferably between two neighbouring folds, of the folding structure. By this, the continuous profile of susceptor may be inserted in the partially gathered tobacco substrate keeping a folded structure or regularity of such a folded structure of the folded tobacco substrate. Preferably, the tobacco substrate is provided in the form of a sheet and is gathered or folded into a rod shape. Preferably, the longitudinally running folding structure provides the tobacco substrate with a wave-like cross section.

Preferably, the continuous profile of susceptor is a continuous sheet of susceptor. Preferably, the continuous sheet of susceptor is provided on a bobbin. Preferably, a width of the sheet of susceptor is the width of the susceptor in a final product. A profile of susceptor in the form of a sheet allows to provide heat in a tobacco rod, which heat may originate over the diameter of the rod and along the length of the rod, preferably the entire length of the rod. By this, a heat distribution in the tobacco rod similar to the conventionally heated heating devices comprising heating blades may be achieved, however, requiring less power and providing all advantages of contactless heating (for example, no broken blades, no residues on heating element, separated electronics or facilitated cleaning of the device).

According to another aspect of the method according to the invention, the method further comprises the step of forming a channel in partially converged tobacco substrate and positioning the continuous profile of susceptor in the channel. Preferably, an inserter for forming the channel in the partially converged tobacco substrate is provided. The inserter may additionally support a guiding and the positioning of the continuous profile of susceptor in the tobacco substrate. A channel facilitates the insertion of the continuous substrate and may guarantee the positioning of the susceptor without damaging or deforming the susceptor profile. In addition, the channel may define the position of the susceptor with respect to its localization and insertion depth in the tobacco substrate and in the tobacco rod after entirely converging the tobacco substrate to its final rod shape. An inserter, for example with a circular form or in the form of a wedge, may be inserted into the partially converged tobacco material. The inserter displaces the tobacco substrate, preferably sideways, such that the continuous profile of susceptor material may be positioned in the channel formed by the inserter. The inserter may additionally serve as guiding and positioning support for the susceptor. For example, the susceptor may be aligned with and in the tobacco substrate by the inserter. The susceptor may be guided for example along a recess in the inserter. By this, the position of the susceptor in the tobacco substrate is given by the position of the inserter. Such a position may be supported in view of a lateral position as well as a depth in the tobacco rod. An inserter may, for example, be provided with a slit. The continuous profile of susceptor may then be guided preferably, at least partially in the slit. For example, a continuous sheet of susceptor material may be inserted into the slit entirely or only partially, while passing through the slit in the inserter.

According to a further aspect of the method according to the invention, the method further comprises the step of wrapping the inductively heatable tobacco rod in a wrapper material. The wrapper material wrapped around the tobacco rod may help to stabilize the shape of the aerosol-forming tobacco substrate. It may also help to prevent an inadvertent disassociation of the tobacco substrate and the susceptor.

In general, the so manufactured inductively heatable tobacco rod is cut into inductively heatable tobacco segments. Preferably, the cut tobacco segments are of equal length. Depending on the consumable or inductively heatable smoking article to be manufactured using an inductively heatable tobacco segment, a length of the segments may be varied. Preferably, a cutting is performed without reorientation of a rod. Preferably, cutting is performed in a vertical direction. Preferably, a continuous profile of susceptor is positioned and oriented in the rod such that no deformation of the susceptor occurs during cutting. The shape of the susceptor has an effect on induction heating and should therefor either be avoided or occur in a controlled manner.

According to another aspect of the invention, there is provided an inductively heatable smoking article for use in an inductive heating device. The inductively heatable smoking article comprises an inductively heatable tobacco segment. The inductively heatable tobacco segment is a portion of an inductively heatable tobacco rod, which inductively heatable tobacco rod has been manufactured according to the method as described in this application. The inductively heatable tobacco segment comprises aerosol-forming tobacco substrate and a susceptor element. In general, an inductively heatable smoking article is introduced into a cavity of the inductive heating device such that heat may be induced in the susceptor element of the tobacco segment by a corresponding inductor of a power supply electronics arranged in the inductive heating device.

An inductively heatable tobacco segment or (final-length) tobacco plug achieves its desired length by cutting the inductively heatable tobacco rod. Such a tobacco segment may have a segment length in a range between about 2 millimeter and about 20 millimeter, more preferably between about 6 millimeter and about 15 millimeter, for example between 8 millimeter and 12 millimeter such as 10 millimeter or 12 millimeter. Due to the manufacturing process, a susceptor element in the tobacco plug has a same length as the tobacco plug. Thus, the susceptor element preferably has a length of between about 2 millimeter and about 20 millimeter, more preferably between about 6 millimeter to about 15 millimeter, for example between about 8 millimeter and about 12 millimeter such as 10 millimeter or 12 millimeter.

Whenever the term 'about' is used in connection with a particular value throughout this application this is to be understood such that the value following the term 'about' does not have to be exactly the particular value due to technical considerations. However, the term 'about' is understood as explicitly including and disclosing the respective boundary value.

Preferably, the susceptor element has a length dimension that is greater than its width dimension or its thickness dimension, for example greater than twice its width dimension or its thickness dimension.

The tobacco segment or tobacco plug, respectively, may be attached to a mouthpiece, which optionally may comprise a filter plug and further segments, for example aerosol-cooling segments or spacer segments. The inductively heatable aerosol-forming tobacco plug and the mouthpiece and possibly also the further segments may be assembled to form a structural entity. Every time a new inductively heatable tobacco plug is to be used in combination with an inductive heating device, the user is automatically provided with a new mouthpiece, which might be appreciated from a hygienic point of view. Optionally the mouthpiece may be provided with a filter plug, which may be selected in accordance with the composition of the tobacco plug.

Advantages and further aspect of the smoking article have been discussed relating to the method according to the invention and will not be repeated.

The invention is further described with regard to embodiments, which are illustrated by means of the following drawings, wherein:

FIG. 1 schematically illustrates an embodiment of the method according to the invention;

FIGS. 2, 3 show cross-sections through the manufacturing line of FIG. 1 at different positions;

FIG. 4 schematically illustrates another embodiment of the method according to the invention;

Figure 1:
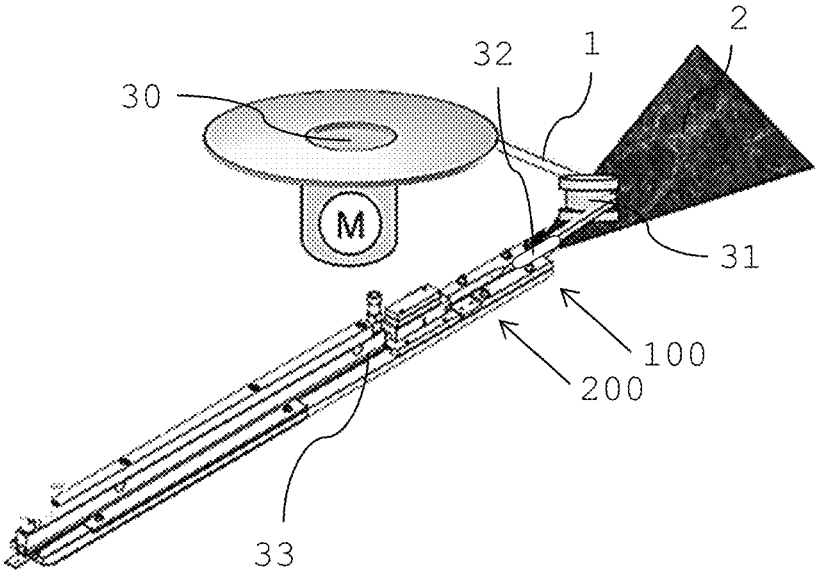

In FIG. 1 a continuous tobacco sheet 2 is guided along a converging device, where the tobacco sheet 2 is gathered from an essentially flat shape to a rod shape. The tobacco sheet 2, for example a cast leaf, may be crimped already or being crimped in-line before being gathered.

A continuous band 1 of a susceptor material, for example a ferromagnetic stainless steel band, is provided on a horizontally arranged bobbin 30. The continuous band 1 is unwound from the bobbin 30 and guided to be arranged parallel to the tobacco sheet 2. When arranged parallel to each other, the tobacco sheet 2 and band of susceptor material 1 run in the same transport direction at the same speed.

A deflection roller 31 is provided to support the guiding and alignment of the continuous band 1 relative to the tobacco sheet. In this embodiment the band 1 is arranged with its small side directing versus the tobacco sheet 2. Thus, the band is arranged in a vertical plane, while the tobacco sheet 2 is arranged in a horizontal plane or, more generally, band 1 and sheet 2 are arranged in planes perpendicular to each other.

Figure 2:
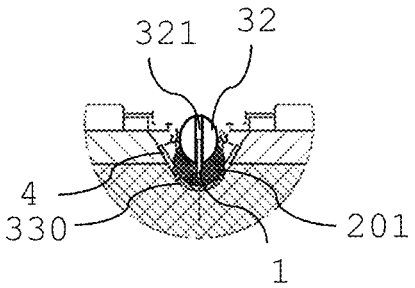

The partially but not entirely gathered tobacco sheet 201 is guided along a groove 330 in a final rod formation and transport line 33. At position 100 arranged at an upstream region of the transport line 33, an inserter 32 is inserted from above into the partially gathered tobacco sheet 201. This is shown in more detail in FIG. 2. The inserter 32 is a tube with an oval shape, for example a metal tube. The tube is arranged parallel to the susceptor band 1 and parallel to the tobacco sheet in an insertion position 100. The tube is with its more narrow side partly inserted into the sheet material 2 along the length of the tube. The length may, for example be more than 3 centimeter, for example between 3 centimeter and 20 centimeter. The inserter 32 forms a channel in the partially gathered tobacco sheet 201 for insertion of the susceptor band 1. The tube is split in a direction perpendicular (vertical) to the transport direction (horizontal) of the tobacco sheet forming a slit 321 in the tube. The slit 321 serves as guiding and positioning means for the susceptor band 1 in the tobacco sheet. The inserter 32 is stationary and the susceptor band 1 passes the slit 321 of the inserter 32. Preferably, a depth of the slit 321 limits a movement of the band 1 in a direction away from the gathered tobacco sheet 201. Thus, the insertion depth of the inserter 32 in the gathered tobacco sheet 201, possibly in combination with the depth of the slit 321 may define the insertion depth of the susceptor band 1 in the final tobacco rod.

Figure 3:
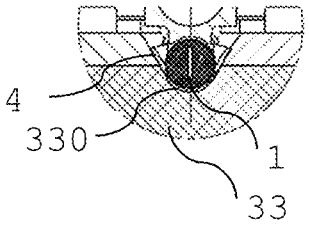

A continuous wrapper material 4, for example a paper sheet or plastics foil, is provided from below the tobacco sheet 2. The wrapper material 4 is inserted into the groove 330 of the transport line 33 such that the partially gathered tobacco sheet 201 comes to lie on the wrapper material 4 in the transport line 33. After susceptor band insertion at position 200, which is shown in more detail in FIG. 3, the susceptor band 1 is entirely enveloped by tobacco substrate around its circumference. In the following, the wrapper material 4 is wrapped entirely around the susceptor containing tobacco substrate forming the final inductively heatable tobacco rod.

Figure 4:
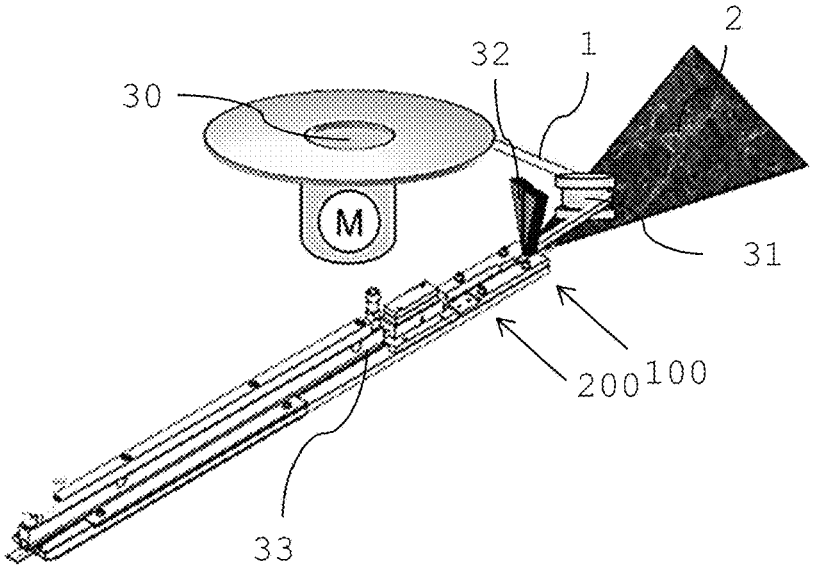
Figure 5:
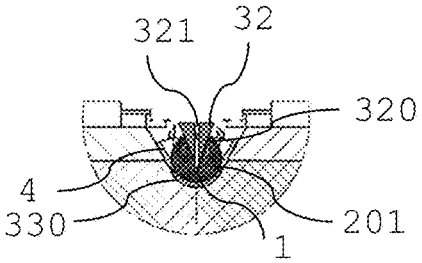
FIG. 5 shows a cross-section through the manufacturing line of FIG. 4.

FIG. 4 shows another embodiment of the method according to the invention with a different inserter 32. The same references are used for the same or similar features. The inserter 32 is wedge-shaped with a narrow tip portion 320 inserted into the sheet material 2 at the insertion position 100. This is also shown in FIG. 5 in more detail. The inserter 32 forms a channel in the partially gathered tobacco sheet 201 for insertion of the susceptor band 1. The tip portion 320 of the inserter 32 is split in a direction perpendicular (vertical) to the transport direction (horizontal) of the tobacco sheet forming a slit 321 in the inserted tip portion 320. The slit 321 serves as guiding and positioning means for the susceptor band 1 in the tobacco sheet. The inserter 32 is stationary and the susceptor band 1 passes the slit 321 of the inserter 32. Preferably, a length of the slit 321 limits a movement of the band 1 in a direction away from the gathered tobacco sheet 201. Thus, the insertion depth of the inserter 32 in the gathered tobacco sheet 201, possibly in combination with the length of the slit 321 may define the insertion depth of the susceptor band 1 in the final tobacco rod.

A vertical insertion and orientation of the continuous profile of susceptor in a rod may be advantageous for a subsequent cutting of the rod into segments. It has been found that by a cutting of the rod also in vertical direction, that is, along the small side of the susceptor sheet, no of low deformation of a susceptor band occurs.

Figure 6:
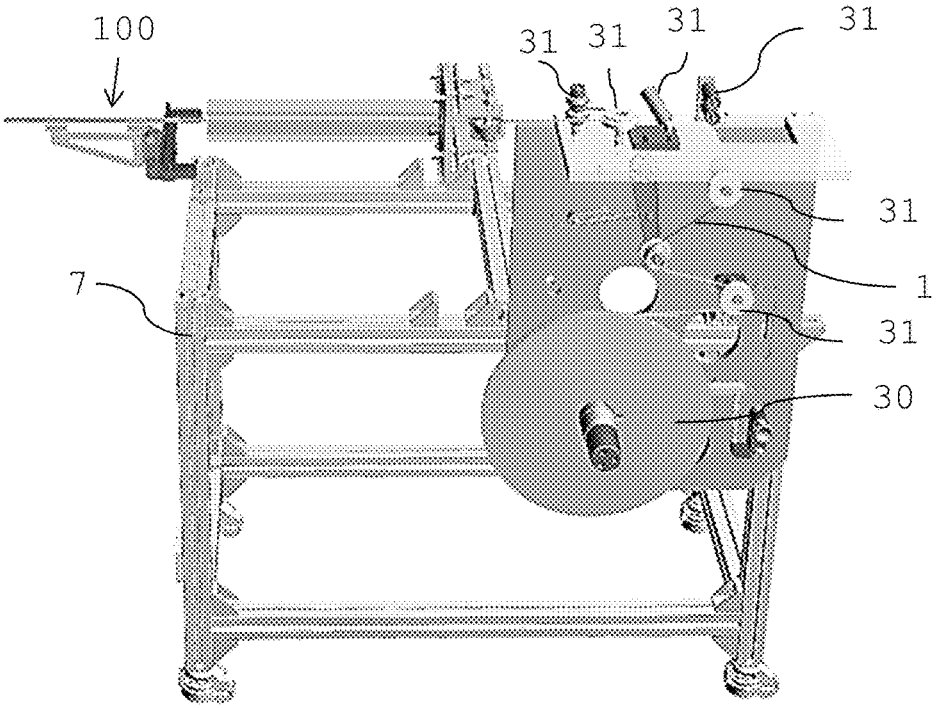
FIG. 6 illustrates a susceptor supply from below a manufacturing line.

FIG. 6 illustrates a susceptor band 1 insertion from below a manufacturing line 33. This may be advantageous in limited space conditions, since a compact arrangement of a manufacturing line may be provided. Depending on the crimping and gathering process of a tobacco sheet, various apparatus elements are arranged along the transport line 33 upstream of the insertion position 100 (no shown in FIG. 6). Thus, the susceptor supply may be arranged beneath the transport line. The bobbin 30 with susceptor band 1 is arranged vertically. Several deflection and guide rollers 31 are provided to transport the susceptor band 1 in a controlled and defined manner to and along the transport line 33. The deflection rollers 31 are arranged and designed to align the susceptor band 1 in the desired orientation in the insertion position 100. In the embodiment shown in FIG. 6 the band is turned by 90 degree from an initial horizontal position at the bobbin 30 to a vertical position at the insertion position 100.

Bobbin 30, rollers 31 and further equipment is mounted to a rack 7. Equipment for tobacco sheet processing, as well as an inserter 32 may also be mounted to the rack 7.

Figure 7:
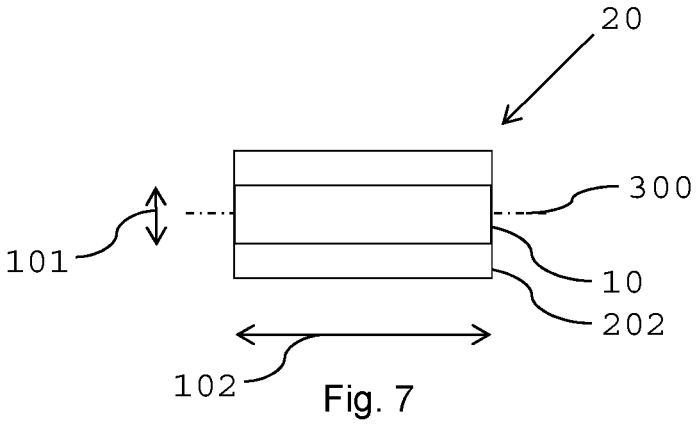
FIG. 7 shows a view onto a longitudinal cross section of an inductively heatable tobacco segment.

The tobacco rod is cut into segments of desired final length forming individual tobacco plugs 20. FIG. 7 shows a view onto a longitudinal cross section through an inductively heatable tobacco plug 20. A strip of susceptor material 10 is arranged along a longitudinal axis 300 of the tobacco plug and has a same length 102 as the tobacco plug. The width 101 of the strip 10 is smaller than the diameter of the tobacco plug. The length of the tobacco plug may for example be 12 millimeter, while the width 101 of the susceptor strip may for example be 4 millimeter. The tobacco substrate preferably comprises a gathered sheet of crimped homogenized tobacco material. The crimped sheet of homogenized tobacco material preferably comprises glycerine as an aerosol-former.

Figure 8A:
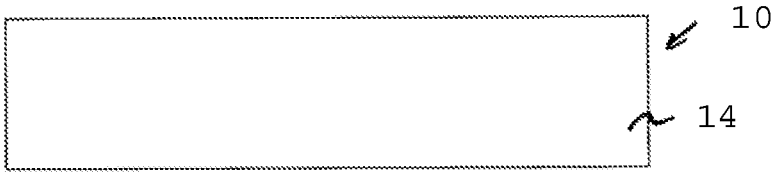
FIG. 8A is a plan view of a susceptor for use in a tobacco product.
Figure 8B:
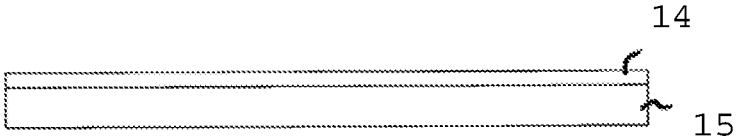
FIG. 8B is a side view of the susceptor of FIG. 8A.

FIG. 8A and FIG. 8B illustrate an example of a unitary multi-material susceptor for use in a tobacco plug as for example shown in FIG. 7. The susceptor 1 is in the form of an elongate strip having a length of 12 mm and a width of 4 mm. The susceptor is formed from a first susceptor material 15 that is intimately coupled to a second susceptor material 14. The first susceptor material 15 is in the form of a strip of grade 430 stainless steel having dimensions of 12 mm by 4 mm by 25 micrometres. The second susceptor material 14 is in the form of a strip of nickel having dimensions of 12 mm by 4 mm by 10 micrometres. The susceptor is formed by cladding the strip of nickel 14 to the strip of stainless steel 15. The total thickness of the susceptor is 35 micrometres. The susceptor 1 of FIG. 8 may be termed a bi-layer or multilayer susceptor.

The invention claimed is:

1. Inductively heatable smoking article comprising an inductively heatable tobacco segment of an inductively heatable tobacco rod, the inductively heatable tobacco rod manufactured by:

providing a continuous profile of a susceptor;

guiding an aerosol-forming tobacco substrate along a tobacco substrate converging device;

forming a channel in partially converged aerosol-forming tobacco substrate;

positioning the continuous profile of the susceptor in the aerosol-forming tobacco substrate channel;

converging the aerosol-forming tobacco substrate to a final rod shape, wherein the step of positioning the continuous profile of the susceptor in the aerosol-forming tobacco substrate is performed before performing the step of converging the aerosol-forming tobacco substrate to its final rod shape, wherein the inductively heatable tobacco segment comprises aerosol-forming tobacco substrate and a susceptor element.

2. Inductively heatable smoking article according to claim 1, wherein a length of the susceptor element in the tobacco segment is equal to the length of the tobacco segment.

3. Inductively heatable smoking article according to claim 1, wherein the susceptor element is positioned in a central portion of the inductively heatable tobacco segment.

4. Inductively heatable smoking article according to claim 1, wherein a length dimension of the susceptor element is arranged to be approximately parallel to a longitudinal direction of the inductively heatable tobacco segment.

5. Inductively heatable smoking article according to claim 1, wherein the susceptor element is arranged along a longitudinal axis of the inductively heatable tobacco segment.

6. Inductively heatable smoking article according to claim 1, wherein the inductively heatable tobacco segment is provided with a longitudinally running folding structure.

7. Inductively heatable smoking article according to claim 6, wherein the longitudinally running folding structure provides the inductively heatable tobacco segment with a wave-like cross-section.

8. Inductively heatable smoking article according to claim 6, wherein the susceptor element is arranged parallel to and in between the longitudinally running folding structure of the inductively heatable tobacco segment.

9. Inductively heatable smoking article according to claim 1, wherein the inductively heatable tobacco segment is made from of a gathered sheet.

10. Inductively heatable smoking article according to claim 9, wherein the sheet is a gathered sheet of crimped homogenized tobacco material.

11. Inductively heatable smoking article according to claim 1, wherein the inductively heatable tobacco segment has a length in a range between 2 millimeter and 20 millimeter.

12. Inductively heatable smoking article according to claim 1, wherein the susceptor element has a width that is smaller than a diameter of the inductively heatable tobacco segment.

13. Inductively heatable smoking article according to claim 1, wherein the susceptor element has the form of a band, wherein the width of the susceptor element is between about 2 millimeter and about 8 millimeter.

14. Inductively heatable smoking article according to claim 13, wherein a thickness of the susceptor element is between about 0.03 millimeter and about 0.15 millimeter.

15. Inductively heatable smoking article according to claim 1, wherein the susceptor element is a multi-layer susceptor.

16. Inductively heatable smoking article according to claim 1, wherein the inductively heatable tobacco segment is attached to a mouthpiece.

* * * * *